US008893332B2

(12) United States Patent
Kavovit

(10) Patent No.: US 8,893,332 B2
(45) Date of Patent: Nov. 25, 2014

(54) CONVERTIBLE PILLOW PURSE

(71) Applicant: DIYVA Holdings LLC, Greenwich, CT (US)

(72) Inventor: Barbara Kavovit, Wainscott, NY (US)

(73) Assignee: DIYVA Holdings, LLC, Greenwich, CT (US)

( * ) Notice: Subject to any disclaimer, the term of this patent is extended or adjusted under 35 U.S.C. 154(b) by 0 days.

(21) Appl. No.: 13/826,778

(22) Filed: Mar. 14, 2013

(65) Prior Publication Data

US 2013/0255000 A1 Oct. 3, 2013

Related U.S. Application Data

(60) Provisional application No. 61/618,192, filed on Mar. 30, 2012.

(51) Int. Cl.

| | |
|---|---|
| ***A47G 9/10*** | (2006.01) |
| ***A45F 4/02*** | (2006.01) |
| ***A45C 3/08*** | (2006.01) |
| *A45C 9/00* | (2006.01) |

(52) U.S. Cl.

CPC ... *A47G 9/10* (2013.01); *A45F 4/02* (2013.01); *A45C 2009/002* (2013.01); *A45C 3/08* (2013.01); *A47G 9/1045* (2013.01); *A45C 9/00* (2013.01); *A45F 2004/026* (2013.01)

USPC ..... 5/639; 5/656; 5/636; 150/100; 150/103; 150/112; 150/118

(58) Field of Classification Search

USPC ..... 5/656, 639

See application file for complete search history.

(56) References Cited

U.S. PATENT DOCUMENTS

2008/0256714 A1* 10/2008 Cubbage et al. ..... 5/656

FOREIGN PATENT DOCUMENTS

GB 2134383 * 8/1984 ..... 5/639

* cited by examiner

*Primary Examiner* — Brittany Wilson

(74) *Attorney, Agent, or Firm* — Gerald E. Hespos; Michael J. Porco; Matthew T. Hespos

(57) ABSTRACT

A purse or bag for carrying accessories and/or personal articles that converts into a pillow is provided. In a first state, the purse or bag includes at least two exterior pockets configured for carrying appropriate sized articles or accessories. In a second state, the purse or bag is turned inside out to expose first and second pillow portions which when zippered, or coupled, together form a single pillow.

19 Claims, 5 Drawing Sheets

CONVERTIBLE PILLOW PURSE

PRIORITY

This application claims priority to U.S. Provisional Patent Application No. 61/618,192, filed on Mar. 30, 2012, the contents of which are hereby incorporated by reference in its entirety.

BACKGROUND

1. Field

The present disclosure relates generally to accessories bags, totes, purses and the like, and more particularly, a purse or bag for carrying accessories or personal articles that converts into a pillow.

2. Description of the Related Art

Purses, totes and travel bags are known in the art. Conventionally, such purses and totes are employed to carry various accessories and personal articles such as a tooth brush, comb, etc.

When traveling, such purses are typically carried by a user separate from a piece of luggage so the user can access the articles contained therein during travel, such as during a flight or a train ride. Additionally, travelers often employ pillows during such travel for added comfort. However, a separate pillow adds to the number of items a traveler or user has to carry or coordinate during their travel, making travel cumbersome.

Therefore, a need exists for an apparatus for carrying accessories or personal articles, for example travel accessories, where such an apparatus can convert into a pillow for use without adding to a number of articles a user has to carry.

SUMMARY

A purse or bag for carrying accessories and/or personal articles that converts into a pillow is provided. In a first state, the purse or bag includes at least two exterior pockets configured for carrying appropriate sized articles or accessories. In a second state, the purse or bag is turned inside out to expose first and second pillow portions which when zippered, or coupled, together form a single pillow.

The purse or bag of the present disclosure includes a body for carrying articles and at least two handles. In certain embodiments, the purse includes a removable shoulder strap. The body of the purse includes a first pillow portion and a second pillow portion coupled by a flexible support member at a lower portion of each of the first and second pillow portions. The flexible support member supports the purse in an upright position when the purse is placed on a flat, horizontal surface. An upper portion of each of the first and second pillow portions are joined by a first zipper assembly arranged on the outer periphery to close the purse or bag.

The first pillow portion includes a exterior surface and an interior surface. The exterior surface includes a first pocket which is exposed by a second zipper assembly. The first pocket is configured to carry appropriate sized articles. Similarly, the second pillow portion includes a exterior surface and an interior surface. The exterior surface of the second pillow portion includes a second pocket which is exposed by a third zipper assembly. The second pocket is configured to carry appropriate sized articles.

To convert the purse or bag into a pillow, the first zipper assembly is fully open to enable the first and second pillow portions to hingedly rotate about the flexible support member. The first and second pillow portions are rotated about the flexible support member to bring together in face-to-face contact the exterior surfaces of the first and second pillow portions. The first zipper assembly is then engaged to couple the first and second pillow portions to configure the pillow. In this state, the interior surfaces of the first and second pillow portions are now the exterior surfaces of the pillow. The exterior surfaces of the pillow may be configured form any know appropriate material.

When converted to a pillow, the apparatus of the present disclosure may be employed by a user as a source of comfort for the user's back, legs, neck, head, etc. during any prolonged period of sitting.

According to one aspect of the present disclosure, a convertible bag is provided including a first pillow portion including a first surface and a second surface, the first surface including a first pocket configured for storing at least one article; a second pillow portion including a first surface and a second surface, the first surface including a second pocket configured for storing at least one article; a flexible support member configured to couple a lower portion of each of the first and second pillow portions; and a coupling assembly configured to couple a periphery of an upper portion of the first pillow portion to a periphery of an upper portion of the second pillow portion, wherein in a first position, the second surface of the first pillow portion is in face to face arrangement with the second surface of the second pillow portion exposing the first and second pockets and, in a second position, the first surface of the first pillow portion is in face to face arrangement with the first surface of the second pillow portion.

In another aspect, the coupling assembly is a zipper assembly.

In a further aspect, the coupling assembly includes hook and loop fasteners.

In yet another aspect, an inner cavity of the first and second pillow portions includes a material selected from the group consisting of foam, memory foam, down feathers and microbeads.

In another aspect, the first surfaces of the first and second pillow portions and the second surfaces of the first and second pillow portions are configured from the same material.

In still a further aspect, the first surfaces of the first and second pillow portions are configured from a first material and the second surfaces of the first and second pillow portions are configured from a second, different material.

According to another aspect of the present disclosure, a convertible knapsack includes a first pillow portion including a first surface and a second surface, the first surface including a first pocket configured for storing at least one article; a second pillow portion including a first surface and a second surface, the first surface including at least two shoulder straps configured for carrying the knapsack; a flexible support member configured to couple a lower portion of each of the first and second pillow portions; and a coupling assembly configured to couple a periphery of an upper portion of the first pillow portion to a periphery of an upper portion of the second pillow portion, wherein in a first position, the second surface of the first pillow portion is in face to face arrangement with the second surface of the second pillow portion exposing the first and second pockets and, in a second position, the first surface of the first pillow portion is in face to face arrangement with the first surface of the second pillow portion.

BRIEF DESCRIPTION OF THE DRAWINGS

The above and other aspects, features, and advantages of the present disclosure will become more apparent in light of the following detailed description when taken in conjunction with the accompanying drawings in which.

DETAILED DESCRIPTION

Figure 1:
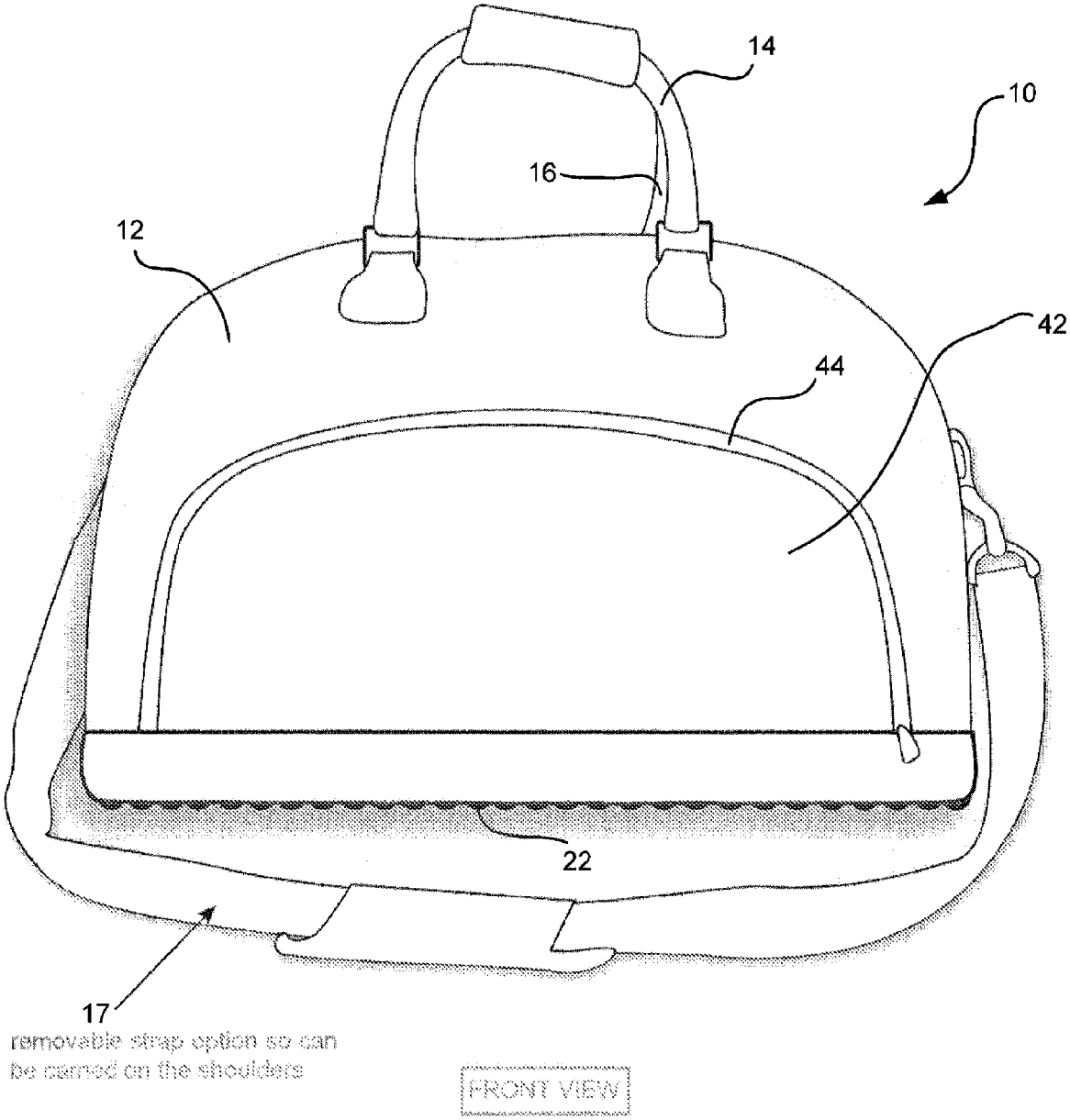
FIG. 1 is a front view of a convertible pillow purse or bag in accordance with an embodiment of the present disclosure.

Preferred embodiments of the present disclosure will be described hereinbelow with reference to the accompanying drawings. In the following description, well-known functions or constructions are not described in detail to avoid obscuring the present disclosure in unnecessary detail.

Referring to the Figures, a convertible pillow purse or bag 10 is illustrated. The pillow purse 10 includes a body 12 for carrying articles and at least two handles 14, 16. In certain embodiments, the purse 10 includes a removable shoulder strap 17 coupled to the body 12 so the purse or bag 10 can be carried on a shoulder of a user. The body 12 includes a first pillow portion 18 and a second pillow portion 20 coupled by a flexible support member 22 at a lower portion of each of the first and second pillow portions 18, 20. The flexible support member 22 supports the purse 10, i.e., the first and second pillow portions 18, 20, in an upright position when the flexible support member 22 is placed on a flat, horizontal surface. A periphery or outer circumference of an upper portion of each of the first and second pillow portions 18, 20 are joined by a first zipper assembly 24, or coupling assembly. It is to be appreciated that other devices and means may be employed to join or couple the periphery of the upper portions of the first and second pillow portions together, for example, hook and loop fasteners, also known as Velcro™.

The first pillow portion 18 includes a exterior surface 26 and an interior surface 28. The exterior surface 26 includes a first pocket 30 which is exposed by a second zipper assembly 32. The first pocket 30 is configured to carry appropriate sized articles. Similarly, the second pillow portion 20 includes a exterior surface 34 and an interior surface 36. The exterior surface 34 includes a second pocket 38 which is exposed by a third zipper 40. The second pocket 38 is configured to carry appropriate sized articles.

It is to be appreciated that either the first or second pillow portions may include a third pocket for carrying accessories. For example, referring to FIGS. 1 and 2A, a third pocket 42 is configured in the exterior surface 26 of the first pillow portion 18. The third pocket 42 is exposed by fourth zipper assembly 44.

Figures 2A, 2B:
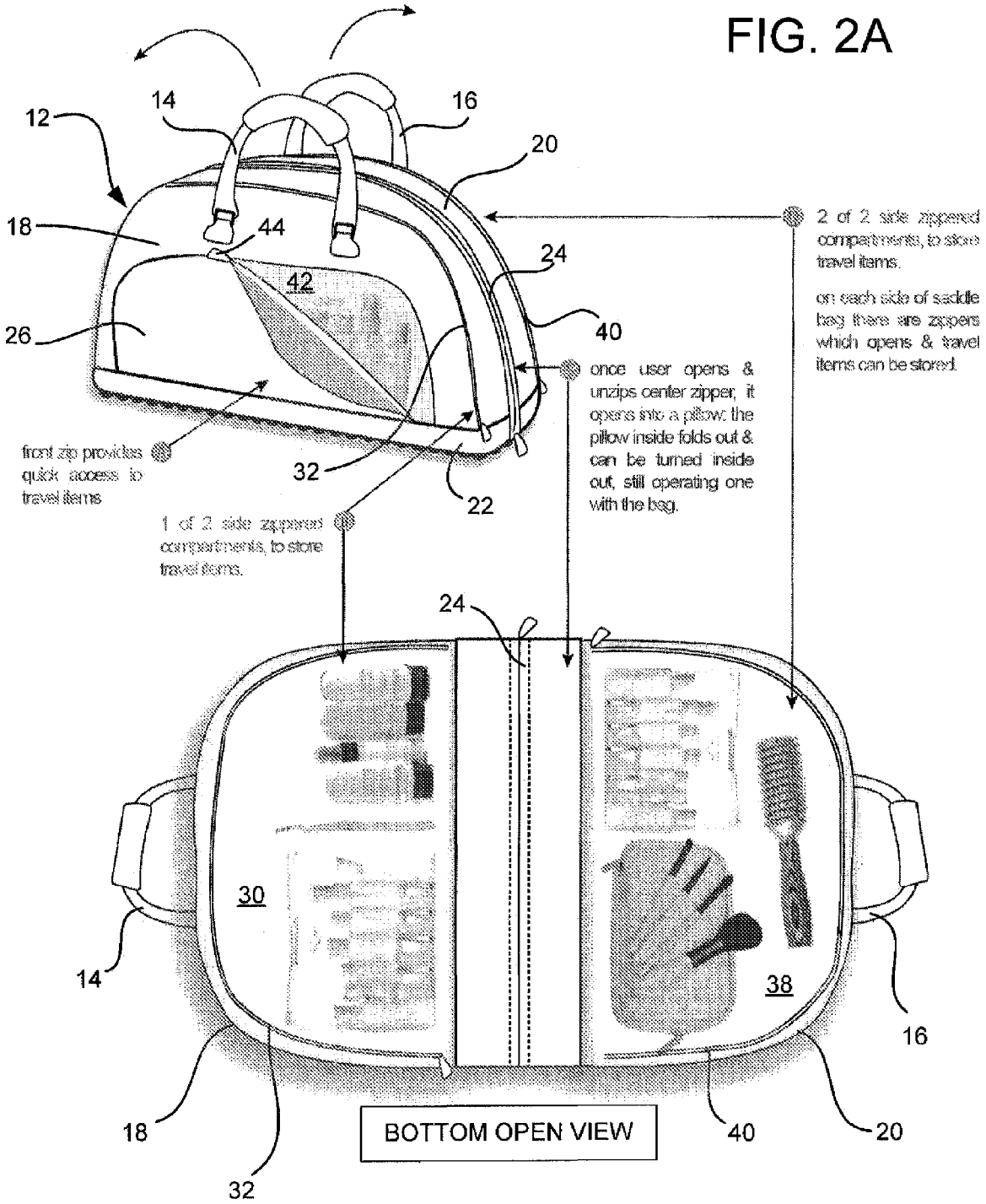
FIG. 2A is a perspective view of a convertible pillow purse or bag in accordance with an embodiment of the present disclosure.
FIG. 2B is a bottom open view of a convertible pillow purse or bag in accordance with an embodiment of the present disclosure.

Referring to FIG. 2A, the purse 10 is shown in a closed state. In this state, the purse 10 is used to carry articles in each of the first and second pockets 30, 38. Furthermore, in this state, the interior surfaces 28, 36 of the first and second pillow portions 18, 20, respectively, are in a face-to-face arrangement. The purse 10 is converted to a fully open state by exercising the first zipper assembly 24. Referring to FIG. 2B, an open bottom view of the purse 10 is illustrated. The purse 10 is shown in the fully open state with the exterior surfaces 26, 34 shown as invisible to illustrates various articles in each of the first and second pockets 30, 38. Access to each of the first and second pockets 30, 38 is provided via second zipper 32 and third zipper 40 respectively.

Figure 3:
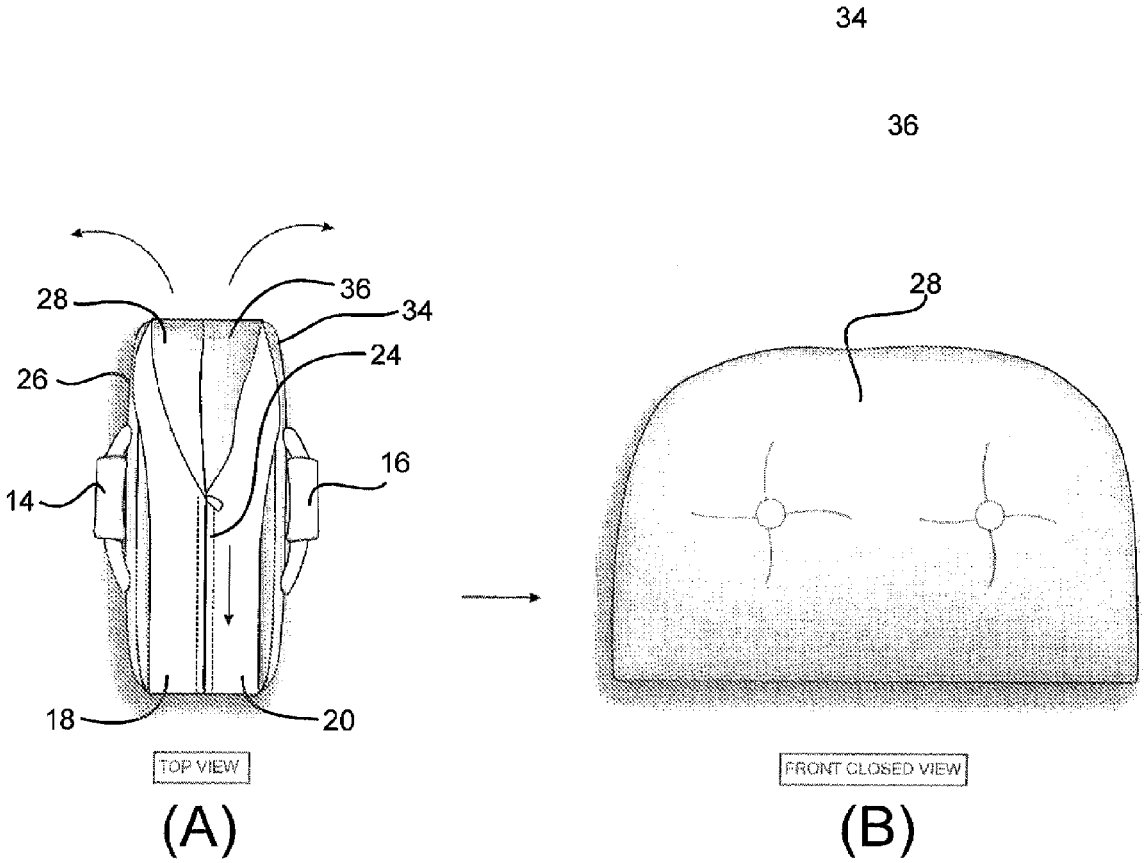
FIG. 3A a top view of a convertible pillow purse or bag in a purse or bag configuration in accordance with an embodiment of the present disclosure.
FIG. 3B is a side view of the convertible pillow purse or bag after being converted to a pillow configuration.
Figure 4:
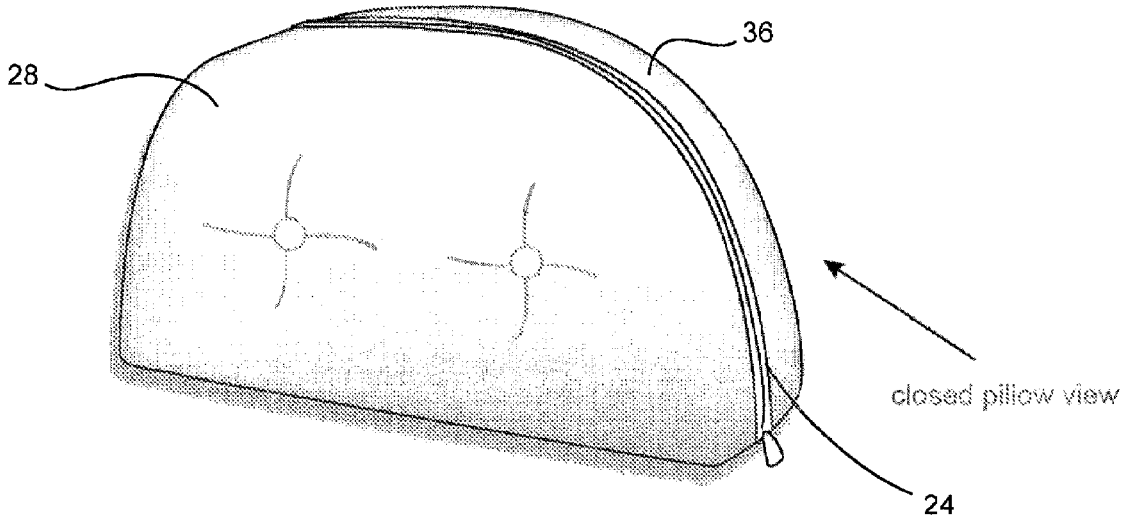
FIG. 4 is a perspective view of a convertible pillow purse or bag in a pillow configuration in accordance with an embodiment of the present disclosure.

The purse 10 can then be converted into a pillow by bringing the exterior surfaces 26, 34 of the first and second pillow portions 18, 20 together in a face-to-face arrangement. To convert the purse into a pillow, the first zipper assembly 24 is fully open to enable the first and second pillow portions 18, 20 to hingedly rotate about the flexible support member 22. When the first zipper assembly 24 is fully open, the first and second pillow portions remain attached to each other via the support member 22. The first and second pillow portions 18, 20 are rotated about the flexible support member 22 to bring together in face-to-face contact the exterior surfaces 26, 34 of the first and second pillow portions 18, 20. The first zipper assembly 24 is then engaged to coupled the periphery or outer circumference of first and second pillow portions 18, 20 to configure the pillow. In this state, the interior surfaces 28, 36 of the first and second pillow portions are now the exterior surfaces of the pillow. As shown in FIGS. 3B and 4, when converted into a pillow, the interior surfaces 28, 36 of the first and second pillow portions 18, 20 are now exposed, exterior surfaces of the converted pillow.

Figure 5A:
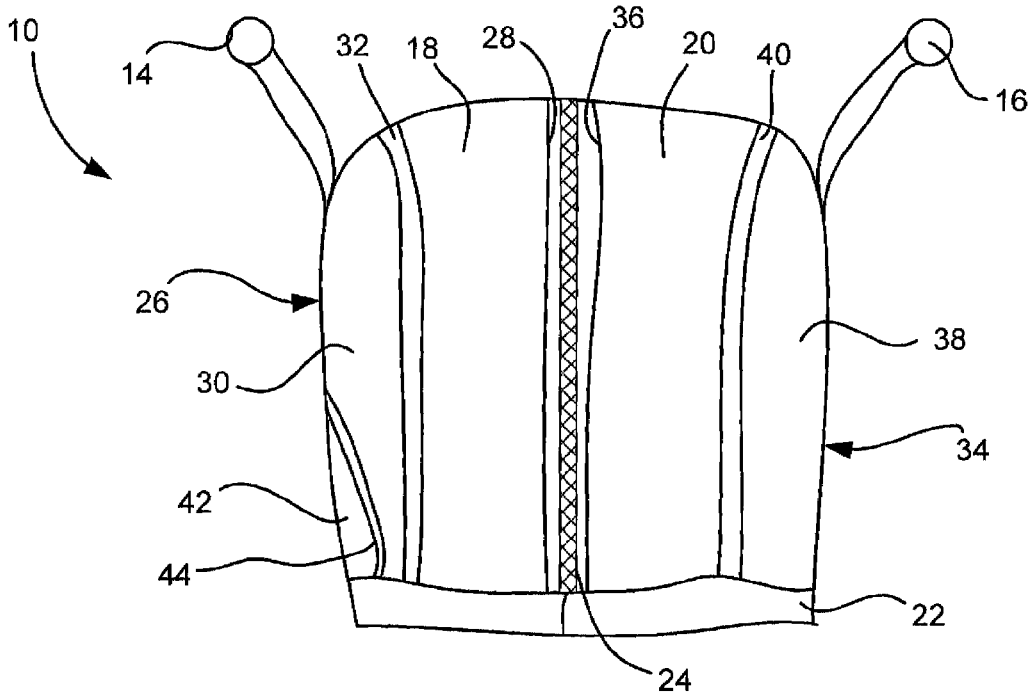
FIG. 5A is a cross sectional view of a convertible pillow purse or bag in a first state in accordance with an embodiment of the present disclosure.

Referring to FIG. 5A, a cross sectional view of the purse or bag 10 in a first state is provided. It is to be appreciated that the purse or bag 10 in this state is employed to carry articles, where the first handle 14 is coupled to the exterior surface 26 of the first pillow portion 18 and the second handle 16 is coupled to the exterior surface 34 of the second pillow portion 20. As shown in FIG. 5A, the interior surfaces 28 of the first pillow portion is in a face-to-face arrangement with the interior surface 36 of the second pillow portion 20. Pillow portions 18, 20 may be filled with any appropriate material, such as foam or the like. In one embodiment, the pillow portion portions 18, 20 are packed densely enough to cause the first and second pillow portions 18, 20 to be resilient to stand upright when the support member 22 is placed on a flat or horizontal surface. In one embodiment, the pillow portions 18, 20 are of a generally rectangular shape but other shapes are contemplated to be within the scope of the present disclosure.

Figure 5B:
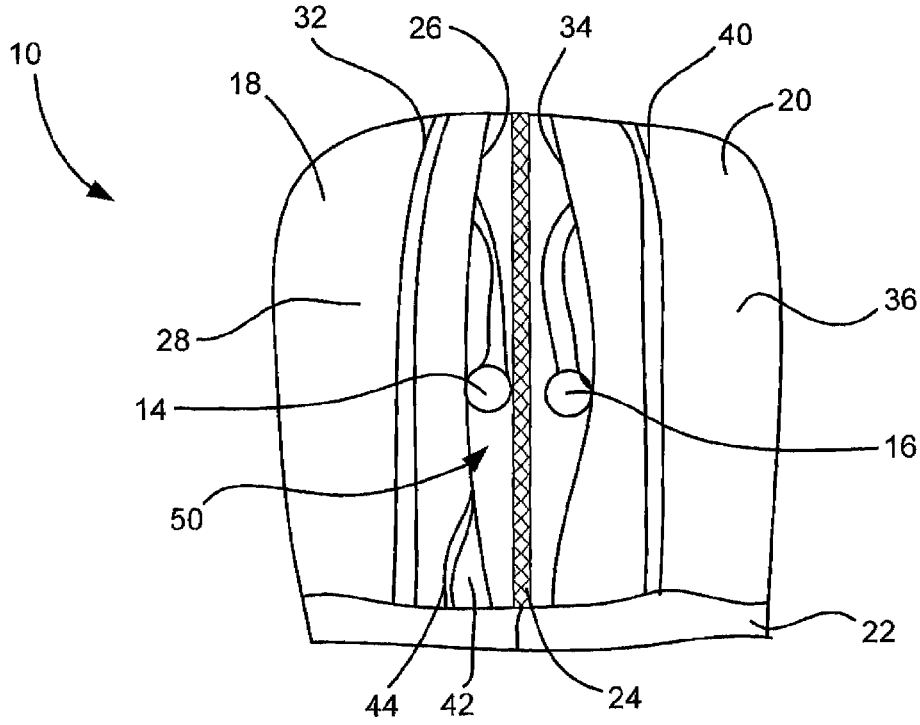
FIG. 5B is a cross sectional view of a convertible pillow purse or bag in a second state in accordance with an embodiment of the present disclosure.

Referring to FIG. 5B, a cross sectional view of the purse or bag 10 in a second state is provided. It is to be appreciated that the purse or bag 10 in this state is employed as a pillow. As shown in FIG. 5B, the surfaces 28, 36 are now exterior facing surfaces. The exterior surfaces 26 of the first pillow portion 18 is now in a face-to-face arrangement with the interior surface 34 of the second pillow portion 20. As shown in FIG. 5B, the handles 14, 16 are now concealed within the cavity 50 formed when the zipper assembly 24 is exercised to couple the periphery of the first and second pillow portions.

It is to be appreciated that surfaces 28, 36 of the first and second pillow portions 18, 20 may be configured from various known materials such as cloth, polyester, etc. In one embodiment, the interior surfaces 28, 36 and exterior surfaces 26, 38 are configured from the same material. In another embodiment, the interior surfaces 28, 36 are configured from a first material, e.g., cloth, and the exterior surfaces 26, 28 are configured from a second, different material. An inner cavity of the first and second pillow portions 18, 20 may be filled with various known materials including, but not limited to, foam, memory foam, down feathers, microbeads, etc.

It is further to be appreciated that the flexible support member 22 can be configured from various materials such as rubber to enable the first and second pillow portions to rotate about the flexible support member 22 while protecting the bottom of the purse 10. In other embodiments, the support member 22 may be other flexible material, e.g., cloth, leather, etc., which may simply deform to allow the pillow portions to move from the first state to the second state as described above.

It is to be further appreciated that the apparatus 10 of the present disclosure may take other forms than a bag or purse. Referring to FIGS. 6A through 6E, a convertible knapsack 100 is illustrated. The knapsack 100 includes a first pillow portion 118 and a second pillow portion 120 coupled together by zipper assembly 124. First and second shoulder straps 114, 116 respectively are coupled to the exterior surface of the second pillow portion 120 to enable a user to carry the knapsack 100. The first pillow portion 118 includes a first pocket 130 exposed by zipper assembly 132. In one embodiment, the first pillow portion 118 includes a second pocket 142 exposed by zipper assembly 144.

Figure 6B:
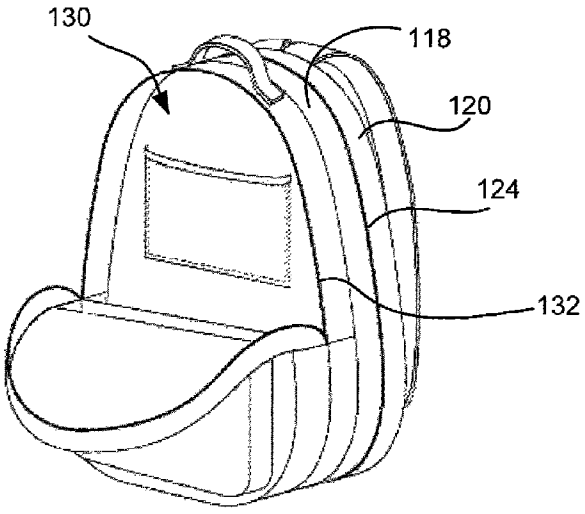
FIGS. 6A-6E illustrates a convertible knapsack in accordance with an embodiment of the present disclosure.
Figure 6A:
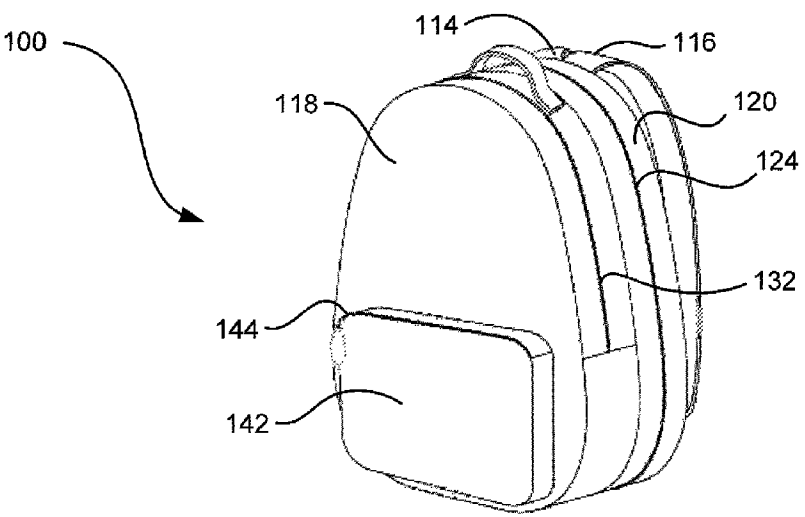
Figure 6E:
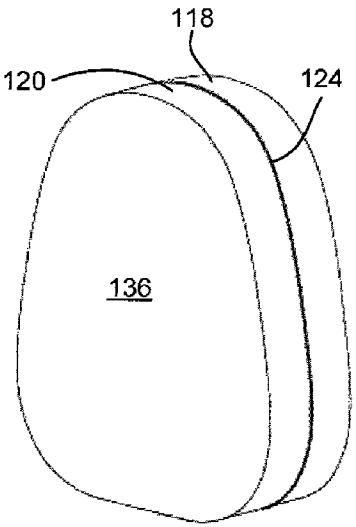
Figure 6D:
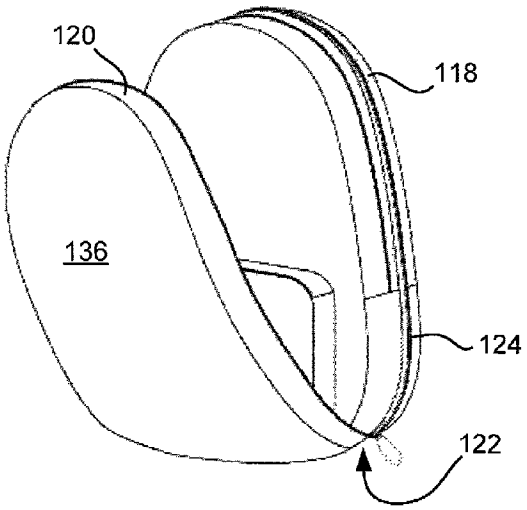
Figure 6C:
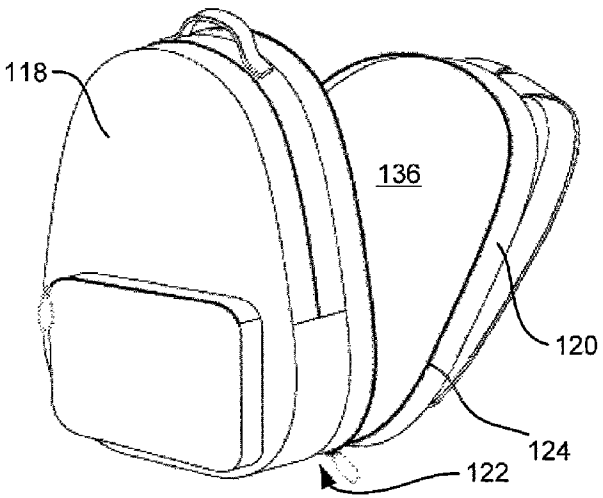

As shown in FIG. 6C, the zipper assembly 124 may be exercised to expose an interior surface 136 of the second pillow portion 120 (the interior surface of first pillow portion 118 is not shown). The second pillow portion 120 may then be rotated about the support member 122, as shown in FIG. 6D, where the periphery of the first and second pillow portions 118, 120 may be coupled by zipper assembly 124 to achieve the second state, i.e., in the state of a pillow.

While the disclosure has been shown and described with reference to certain preferred embodiments thereof, it will be understood by those skilled in the art that various changes in form and detail may be made therein without departing from the spirit and scope of the disclosure.

Furthermore, although the foregoing text sets forth a detailed description of numerous embodiments, it should be understood that the legal scope of the invention is defined by the words of the claims set forth at the end of this patent. The detailed description is to be construed as exemplary only and does not describe every possible embodiment, as describing every possible embodiment would be impractical, if not impossible. One could implement numerous alternate embodiments, using either current technology or technology developed after the filing date of this patent, which would still fall within the scope of the claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

What is claimed is:

1. A convertible bag comprising:

a first pillow portion including a first surface and a second surface, the first surface including a first pocket configured for storing at least one article;

a second pillow portion including a first surface and a second surface, the first surface including a second pocket configured for storing at least one article;

a flexible support member configured to hingedly couple a lower portion of the first pillow portion to a lower portion of the second pillow portion; and a coupling assembly configured to couple an outer periphery of an upper portion of the first pillow portion to an outer periphery of an upper portion of the second pillow portion, wherein in a first position, the second surface of the first pillow portion is in face to face arrangement with the second surface of the second pillow portion exposing the first and second pockets and, in a second position, the first surface of the first pillow portion is in face to face arrangement with the first surface of the second pillow portion.

2. The convertible bag as in claim 1, wherein the coupling assembly is a zipper assembly.

3. The convertible bag as in claim 1, wherein the coupling assembly includes hook and loop fasteners.

4. The convertible bag as in claim 1, wherein the flexible support member is configured to support the first and second pillow portions in an upright position when the flexible support member is placed on a flat horizontal surface.

5. The convertible bag as in claim 1, wherein the first surface further includes a third pocket configured for storing at least one article.

6. The convertible bag as in claim 1, wherein in the second position, the first surface of the first pillow portion defined a cavity with the first surface of the second pillow portion.

7. The convertible bag as in claim 1, further comprising a first handle coupled to the upper portion of the exterior surface of the first pillow portion and a second handle coupled to the upper portion of the exterior surface of the second pillow portion.

8. The convertible bag as in claim 7, wherein in the second position, the first surface of the first pillow portion defines a cavity with the first surface of the second pillow portion, the first and second handles being concealed in the cavity.

9. The convertible bag as in claim 1, wherein an inner cavity of the first and second pillow portions includes a material selected from the group consisting of foam, memory foam, down feathers and microbeads.

10. The convertible bag as in claim 1, wherein the first surfaces of the first and second pillow portions and the second surfaces of the first and second pillow portions are configured from the same material.

11. The convertible bag as in claim 1, wherein the first surfaces of the first and second pillow portions are configured from a first material and the second surfaces of the first and second pillow portions are configured from a second, different material.

12. A convertible knapsack comprising:

a first pillow portion including a first surface and a second surface, the first surface including a first pocket configured for storing at least one article;

a second pillow portion including a first surface and a second surface, the first surface including at least two shoulder straps configured for carrying the knapsack;

a flexible support member configured to hingedly couple a lower portion of the first pillow portion to a lower portion of the second pillow portion; and a coupling assembly configured to couple an outer periphery of an upper portion of the first pillow portion to an outer periphery of an upper portion of the second pillow portion, wherein in a first position, the second surface of the first pillow portion is in face to face arrangement with the second surface of the second pillow portion exposing the first and second pockets and, in a second position, the first surface of the first pillow portion is in face to face arrangement with the first surface of the second pillow portion.

13. A convertible bag comprising:

a first pillow portion including a first surface and a second surface, the first surface including a first pocket configured for storing at least one article;

a second pillow portion including a first surface and a second surface, the first surface including a second pocket configured for storing at least one article;

a flexible support member configured to hingedly couple a lower portion of the first pillow portion to a lower portion of the second pillow portion; and a coupling assembly configured to couple an outer periphery of an upper portion of the first pillow portion to an outer periphery of an upper portion of the second pillow portion, the coupling assembly extending around the outer peripheries of the first and second pillow portions from a first end of the support member to a second end of the support member, wherein in a first position, the second surface of the first pillow portion is in face to face arrangement with the second surface of the second pillow portion exposing the first and second pockets and, in a second position, the first surface of the first pillow portion is in face to face arrangement with the first surface of the second pillow portion exposing the second surface of the first pillow portion and the second surface of the second pillow portion.

14. The convertible bag as in claim 13, wherein the coupling assembly is a zipper assembly.

15. The convertible bag as in claim 13, wherein the coupling assembly includes hook and loop fasteners.

16. The convertible bag as in claim 13, wherein the flexible support member is configured to support the first and second pillow portions in an upright position when the flexible support member is placed on a flat horizontal surface.

17. The convertible bag as in claim 13, further comprising a first handle coupled to the upper portion of the exterior surface of the first pillow portion and a second handle coupled to the upper portion of the exterior surface of the second pillow portion.

18. The convertible bag as in claim 17, wherein in the second position, the first surface of the first pillow portion defines a cavity with the first surface of the second pillow portion, the first and second handles being concealed in the cavity.

19. The convertible bag as in claim 13, wherein an inner cavity of the first and second pillow portions includes a material selected from the group consisting of foam, memory foam, down feathers and microbeads.

* * * * *